US009510412B2

(12) United States Patent
Radermacher

(10) Patent No.: US 9,510,412 B2
(45) Date of Patent: Nov. 29, 2016

(54) LIGHTING SYSTEM

(71) Applicant: KONINKLIJKE PHILIPS N.V., Eindhoven (NL)

(72) Inventor: Harald Josef Günther Radermacher, Aachen (DE)

(73) Assignee: KONINKLIJKE PHILIPS ELECTRONICS N.V., Eindhoven (NL)

( * ) Notice: Subject to any disclaimer, the term of this patent is extended or adjusted under 35 U.S.C. 154(b) by 178 days.

(21) Appl. No.: 14/375,898

(22) PCT Filed: Feb. 4, 2013

(86) PCT No.: PCT/IB2013/050923

§ 371 (c)(1),
(2) Date: Jul. 31, 2014

(87) PCT Pub. No.: WO2013/118039

PCT Pub. Date: Aug. 15, 2013

(65) Prior Publication Data

US 2014/0361710 A1 Dec. 11, 2014

Related U.S. Application Data

(60) Provisional application No. 61/595,744, filed on Feb. 7, 2012.

(51) Int. Cl.
*H05B 33/08* (2006.01)
*F21S 2/00* (2016.01)
(Continued)

(52) U.S. Cl.
CPC ..... *H05B 33/0821* (2013.01); *F21S 2/00* (2013.01); *F21V 23/06* (2013.01);
(Continued)

(58) Field of Classification Search
CPC ..... H05B 33/08
USPC ..... 315/294, 295, 312
See application file for complete search history.

(56) References Cited

U.S. PATENT DOCUMENTS 4,125,781 A 11/1978 Davis, Jr.
4,276,534 A 6/1981 Meyer et al.
2008/0298033 A1* 12/2008 Smith ..... H01R 4/2404 361/772
2009/0219712 A1 9/2009 Verjans et al.
(Continued)

FOREIGN PATENT DOCUMENTS

WO 2009101559 A1 8/2009

OTHER PUBLICATIONS

A. Ogwu, et al., "Electrical Resistivity of Copper Oxide Thin Films Prepared by Reactive Magnetron Sputtering", Journal of Achievements in Materials and Manufacturing Engineering, vol. 24, Issue 1, Sep. 2007, pp. 172-177.
(Continued)

*Primary Examiner* — Minh D A

(57) ABSTRACT

The invention relates to a lighting system comprising: —a substrate comprising a resistive sheet (RS) comprising multiple electrodes (A, B, C, D), each electrode being suitable for connection to a respective voltage source, —a plurality of lighting elements (LEI, LE2, LE3, LE4), each element comprising a light source (LED) and at least two contact pins (CP1, CP2) for electrical connection to respective electrical connection terminals and a control circuit for controlling the light output and/or the color of the light generated by the light source in dependence on the voltage between the contact pins, wherein the electrical connection terminals are distributed over the resistive sheet such that the lighting elements can be connected in different positions and in different orientations, wherein the voltage present between the contact pins depends on the position and orientation of the lighting element and wherein the light output and/or the color of the light generated by the lighting element depends on the magnitude of the voltage between the contact pins of the lighting element.

14 Claims, 5 Drawing Sheets

(51) Int. Cl.

| | |
|---|---|
| ***F21V 23/06*** | (2006.01) |
| *F21Y 101/02* | (2006.01) |
| *F21Y 105/00* | (2016.01) |
| *F21Y 101/00* | (2016.01) |

(52) U.S. Cl.
CPC ..... *H05B 33/0845* (2013.01); *H05B 33/0857* (2013.01); *F21Y 2101/00* (2013.01); *F21Y 2101/02* (2013.01); *F21Y 2105/001* (2013.01); *F21Y 2105/10* (2016.08); *F21Y 2115/10* (2016.08)

(56) References Cited

U.S. PATENT DOCUMENTS

2010/0135022 A1* 6/2010 Deguara ..... H01R 13/73
362/249.06

OTHER PUBLICATIONS

M. Gutierrez, et al., "Thin Film Surface Resistivity", In partial fulfillment of course requirements for Mate 210 Experimental Methods in Materials Engineering, Fall 2002, Prof. G. Selvaduray, pp. 0-24.

* cited by examiner

LIGHTING SYSTEM

CROSS-REFERENCE TO PRIOR APPLICATIONS

This application is the U.S. National Phase application under 35 U.S.C. §371 of International Application No. PCT/IB13/050923, filed on Feb. 4, 2013, which claims the benefit of U.S. Provisional Patent Application No. 61/595,744, filed on Feb. 7, 2012. These applications are hereby incorporated by reference herein.

FIELD OF THE INVENTION

The invention relates to a lighting system comprising a plurality of lighting elements, each comprising a light source, and a substrate to which the lighting elements are detachably connected, at a distance from one another and in an order such that decorative lighting is obtained. The configuration and shape of this decorative lighting can be changed and adapted by a user to any particular purpose.

BACKGROUND OF THE INVENTION

A lighting system is disclosed in US2010/0135022. The known lighting system comprises a substrate equipped with an array of holes provided with holding means. By means of wires, the lighting elements are interconnected in series or in parallel and connected to a control circuit that supplies a current for operation, and are fitted into the holes of the substrate by the holding means. The configuration and shape of the decorative light formed by the lighting system can be changed and adapted by a user to any particular purpose for a substantially unlimited number of times. However, a disadvantage of the known lighting system is that with the number of lighting elements, the amount of wiring increases as well. More in particular, in case of a flat substrate, accommodating all these wires can become problematic.

SUMMARY OF THE INVENTION

The invention aims to provide a lighting system, wherein the amount of wires is very limited even in case the amount of lighting elements is comparatively high.

According to a first aspect of the invention, a lighting system is provided comprising

- a substrate comprising a resistive sheet equipped with multiple electrodes, each electrode being suitable for connection to a respective voltage source,
- a plurality of lighting elements, each element comprising a light source and two contact pins for establishing electrical contact with the resistive sheet, and a control circuit for controlling the light output and/or the color of the light generated by the light source in dependence on the voltage between the contact pins, wherein the lighting elements can be connected in different positions and in different orientations, and wherein the voltage present between the contact pins depends on the position and orientation of the lighting element.

Since the two contact pins of each lighting element are in direct electrical contact with the resistive sheet of the substrate in a lighting system according to the invention, no large amount of wires is necessary, since the lighting elements do not have wires attached to them. As a consequence, there is no need to accommodate a large amount of wires, and since the lighting elements are not connected to wires they are also easy to handle and can easily be positioned anywhere on the substrate. When a voltage is applied to each of the electrodes comprised in the resistive sheet, the voltage between the contact pins of each lighting element depends on the distance between the contact pins, the position on the resistive sheet and also on the orientation of the lighting element with respect to the electric field in the resistive sheet caused by the voltages on the electrodes.

In a first preferred embodiment of a lighting system according to the invention, the resistive sheet is equipped with a plurality of electrical connection terminals. Several possibilities exist to bring the contact pins into contact with the resistive sheet and maintain this contact. It is for instance possible to cover the resistive sheet with a layer of rubber or plastic or a similar material and simply push the contact pins through this layer until they contact the resistive sheet. The contact pins are subsequently held in position by the layer. However, it is often desirable to make sure that the contacts between contact pins and resistive sheet are very dependable. This can be realized by making use of electrical connection terminals.

In a second preferred embodiment of a lighting system according to the invention, the distance between the contact pins of at least part of the lighting elements is adjustable. In case such a lighting element is for instance positioned in a position and in an orientation that are desirable because of a preferred direction of the light generated by the lighting element, the voltage between the contact pins can be adjusted by adjusting the distance between the pins.

In a third preferred embodiment of a lighting system according to the invention, at least part of the light sources comprised in the lighting elements comprise one or more LEDs. LEDs are small, have a high efficiency and a long life time. For these reasons LEDs are very suitable to serve as a light source in the lighting elements of a system according to the invention.

In a fourth preferred embodiment of a lighting system according to the invention, the power consumed by the light source in the light element during operation is supplied by the electrodes through the resistive sheet. Since the power is transferred from the electrodes through the resistive sheet to the electrical connection terminals, no wires between these electrodes and the connection terminals are required, so that also this feature helps to keep the amount of wires low.

In a fifth preferred embodiment of a lighting system according to the invention, the lighting element comprises a battery and the power consumed by the light source in the light element during operation is at least partially supplied from the battery. In this embodiment the power to the light source is supplied in such a way that power dissipation in the resistive sheet is reduced and the efficiency of the lighting system is increased. Preferably, the battery is rechargeable.

In a sixth preferred embodiment of a lighting system according to the invention, the substrate and part of the lighting elements are equipped with circuitry for capacitive or inductive power transfer and the power consumed by the light source in the light element during operation is at least partially supplied via the capacitive or inductive power transfer. Also in this embodiment power dissipation in the resistive sheet is reduced.

In a seventh preferred embodiment of a lighting system according to the invention, the substrate further comprises a first low-resistance sheet, arranged in parallel to the resistive sheet and equipped with at least one electrode, and wherein at least part of the lighting elements comprises a third contact pin for electrical connection to the first low-resistance sheet. By supplying power from the at least one electrode positioned on the first low-resistance sheet, through the first low-resistance sheet, to the lighting element, power dissipation is limited because of the low resistance of the first low-resistance sheet. Preferably, the sixth preferred embodiment further comprises a second low-resistance sheet, arranged in parallel to the resistive sheet and equipped with at least one electrode, and at least part of the lighting elements comprises a fourth contact pin for electrical connection to the second low-resistance sheet. In this latter case, power is supplied through both the first and the second low-resistance sheet, causing a further decrease in power dissipation.

The contact between the third contact pin and the first low-resistance sheet and the contact between the fourth contact pin and the second low-resistance sheet can be realized without making use of electrical connection terminals as explained for instance hereinabove for the contacts between contact pins and the resistive sheet. However, it is often desirable to have a very dependable contact between the contact pins and the low-resistance sheets, so that it is often preferred to equip the first and second low-resistance sheets with electrical connection terminals for establishing the contact between the contact pins and the low-resistance sheets.

According to a second aspect of the invention, a method is provided for operating a lighting system, comprising the steps of

- providing a substrate comprising a resistive sheet comprising multiple electrical connection terminals and multiple electrodes, each electrode being suitable for connection to a respective voltage source,
- providing a plurality of lighting elements, each element comprising a light source and two contact pins for electrical connection to respective electrical connection terminals,
- connecting the electrodes to respective voltage sources,
- connecting the lighting elements in different positions and in different orientations, so that the voltage present between the contact pins depends on the position and orientation of the lighting element, and controlling the light output and/or the color of the light generated by the lighting element in dependence on the magnitude of the voltage between the contact pins of the lighting element.

The advantages of a method according to the invention are similar to those of a lighting system according to the invention.

BRIEF DESCRIPTION OF THE DRAWINGS

Embodiments of the invention will be further described making use of a drawing.

In the drawing.

DESCRIPTION OF EMBODIMENTS

Figure 1:
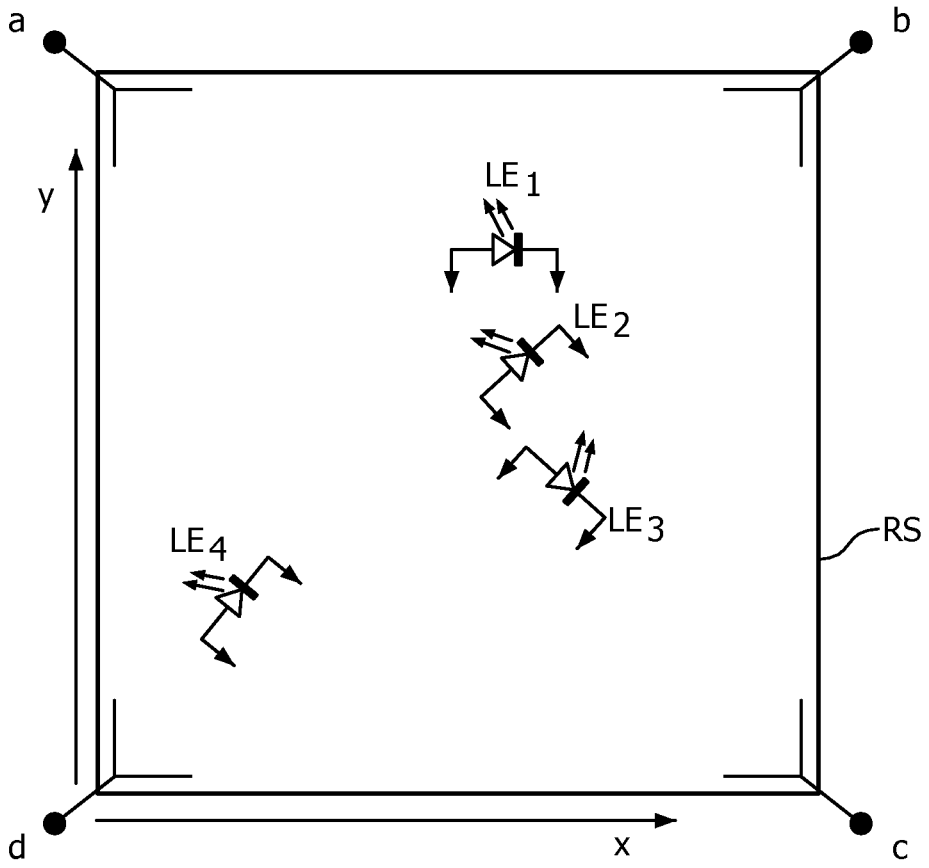
FIG. 1 shows a schematic representation of a first embodiment of a lighting system according to the invention.

In FIG. 1, RS is a resistive sheet comprised in a substrate. Resistive sheet RS is flat and rectangular. In the four corners of said sheet, electrodes A, B, C and D are situated. Electrodes D and C are along an x-axis and electrodes D and A are along an y-axis. Lighting elements LE1, LE2, LE3 and LE4 each comprise two contact pins shown as arrows for electrical connection to connection terminals (not shown) comprised in the resistive sheet RS. The lighting elements further comprise a light source formed by one or more LEDs and a control circuit for controlling the light output and/or the color of the light generated by the light source in dependence on the voltage between the contact pins. It is noted that the contact pins are shown as if they are in the plane of the resistive sheet RS. However, in case the contact pins are connected to the connection terminals, the contact pins are perpendicular to the resistive sheet RS. It is also noted that, in addition to serving as electrical contact, the connection terminals may also serve for mechanical connection purposes. Alternatively, however, the mechanical connection of the lighting element to the substrate may be realized for instance by means of magnetic force, glue, adhesion, hook and loop fastener, suction cup etcetera. It can be seen in FIG. 1 that each of the lighting elements is in a different position and also has a different orientation. Whether a lighting element generates light and how much, depends on the voltages present at the electrodes. This is illustrated in Table I.

Five different situations (states) are considered. In the first situation a positive voltage is present at electrodes A and D and a negative voltage is present at electrodes B and C. In this first situation an electric field exists in the resistive sheet RS in the positive x-direction. Since lighting element LE1 is positioned in parallel to the x-axis, the voltage difference between the contact pins has the highest possible value, given the contact pin distance and the strength of the electric field. As a consequence, lighting element LE1 generates its maximum light output or, in other words, the lighting element is "full on". Lighting elements LE2 and LE3 are both oriented in a diagonal direction at an angle of 45 degrees with respect to the electrical field.

TABLE I

| state | powering | LE1 | LE2 | LE3 | LE4 |
|---|---|---|---|---|---|
| 1 | +A, D<br>−B, C | full on | dimmed | dimmed | off |
| 2 | +A<br>−C | dimmed | off | full on | off |
| 3 | +A, B<br>−D, C | off | off | dimmed | dimmed |
| 4 | +D, C<br>−A, B | off | dimmed | off | off |
| 5 | +B<br>−D | off | off | off | full on |

The voltage between the contact pins is smaller than for lighting element LE1, because the distance between the contact pins, measured along the x-axis, is smaller. As a consequence, both lighting elements LE2 and LE3 generate less light (dimmed operation) than lighting element LE1. Lighting element LE4 is at an angle of 135 degrees with respect to the positive x-direction, so that the voltage present between the contact pins is negative and lighting element LE4 is not generating any light, or in other words LE4 is "off".

In the second situation, electrode A is connected to a positive voltage and electrode C is connected to a negative voltage. An electric field thus exists that extends from electrode A to electrode C. Since lighting elements LE2 and LE4 are perpendicular to this electric field, the voltage between their contact pins is zero and thus these lighting elements are off. Since LE3 is oriented in the same direction as the electric field, lighting element LE3 is full on. Lighting element LE1 is at an angle of 45 degrees with respect to the electric field and is thus in dimmed operation, since the distance between the contact pins measured in the direction of the electric field is smaller than in the case of lighting element LE3, so that the voltage between the contact pins of lighting element LE1 is smaller than that between the contact pins of lighting element LE3. Table I shows the light output of the lighting elements for three more situations. It can be seen in the table that the light output of the lighting elements is different in each situation, or in other words for different voltages present at the electrodes of the resistive sheet. Although the lighting elements cannot be individually addressed, their light output can be controlled by means of the voltages present at the electrodes. The light output of each of the lighting elements can thus be changed by bringing the lighting system in a different state, a state (or situation) being defined by the voltages present at the electrodes. As a consequence, different light effects can be created by bringing the lighting system in different states in a fast repetitive or random sequence for adjustable fractions of time.

The lighting elements shown in FIG. 1 are equipped with only two contact pins and do not comprise a source of electrical power such as a battery or circuitry for inductive or capacitive coupling with a power source. Consequently, the power consumed by the light source comprised in the lighting element is supplied from the electrodes comprised in the substrate via the resistive sheet RS, the connection terminals and the contact pins. In case the light source consists of LEDs of one color, such a light source should be supplied by a current source. In such a lighting element the control circuit comprised in the lighting element is equipped with circuitry for generating a current out of the voltage that is present between the contact pins. At the same time the voltage between the contact pins functions as a signal that determines the magnitude of the current generated by the current source. In case the light source in the lighting element is formed by LEDs of different colors and the voltage between the contact pins functions as a control signal for the color, the control circuit comprises circuitry for generating different currents for LEDs of different colors out of the voltage between the contact pins. At the same time the voltage between the contact pins functions as a signal that determines the magnitudes of these currents. In case both intensity and color of the light generated by the light source in the lighting element need to be controlled by the voltage between the control pins, both the total current supplied to the LEDs and the distribution of this total current to the LEDs of different color is determined by the voltage between the contact pins. In the latter two cases it is possible to equip the control circuit of the lighting element with a processor comprising a memory, wherein the relation between the voltage between the contact pins and the magnitudes of the currents that need to be supplied to the LEDs of different color is stored. However, alternatively, the desired relation between the voltage between the contact pins and the magnitudes of the currents supplied to the LEDs of different color may be realized by means of a control circuit that is formed by a specific hardware configuration of the lighting element.

Figure 2:
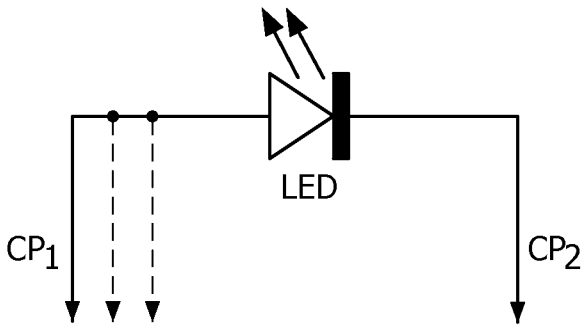
FIGS. 2, 3 and 4 show schematic representations of embodiments of a lighting element for use in a lighting system as shown in FIG. 1.

FIG. 2 shows a lighting element having an adjustable distance between the contact pins. In this lighting element the voltage between the contact pins can be adjusted so that the voltage between the contact pins is not only depending on the position and the orientation of the lighting element but also on the adjusted distance. As a result, the versatility of the system is increased.

Figure 3:
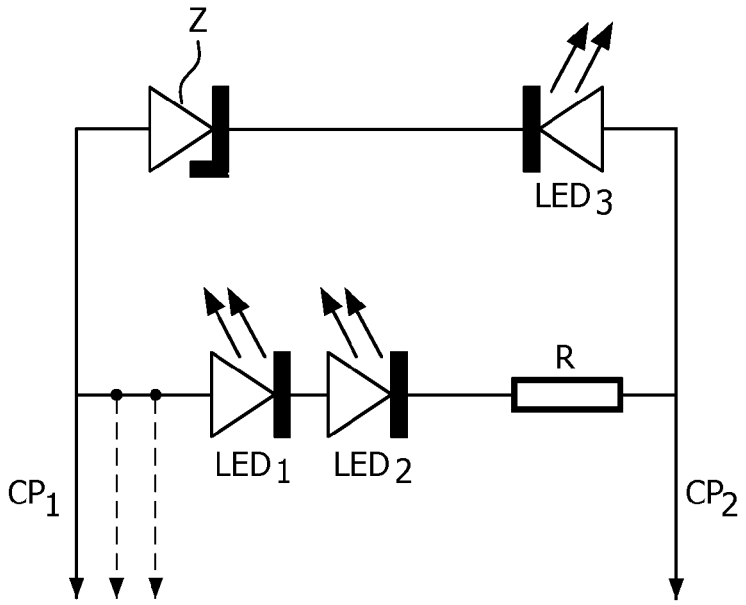

FIG. 3 shows a lighting element having an adjustable distance between the contact pins and comprising two branches. In the first branch there are two LEDs in series with a resistor for one current direction and in the second branch there is a single LED offset by a Zener diode for a second current direction. In case the LEDs in the different branches are for instance LEDs generating light of a different color, the color of the light generated by this lighting element depends on the orientation. The control circuit in this lighting element is formed by the Zener diode and the resistor.

Figure 4:
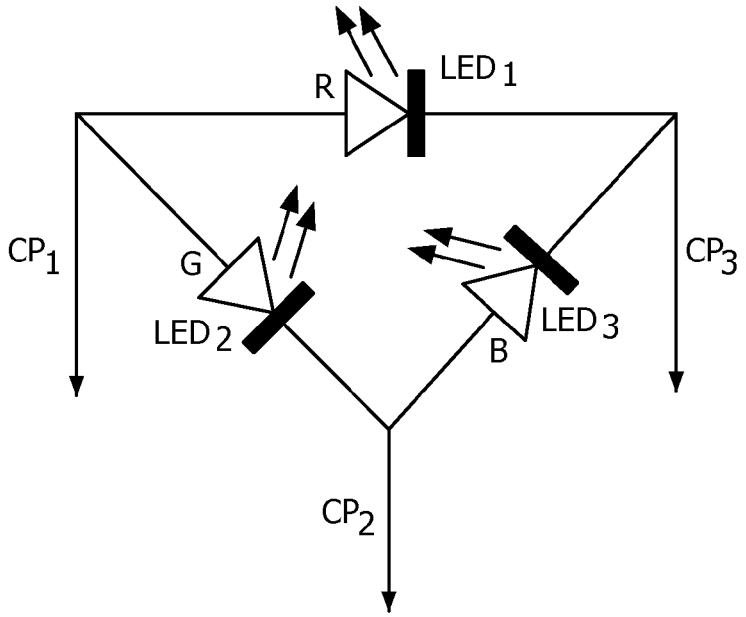

FIG. 4 shows a lighting element with three contact pins and three LEDs of different color. Each one of the LEDs is connected between two contact pins. The color of the light generated by the lighting element depends on the voltages present on the electrodes of the resistive sheet. In case the voltage distribution in the resistive sheet is rotated in a fast sequence, the human eye will perceive a "mixed color". In this way any color within the color gamut of the LEDs can be generated by mixing performed by fast rotation of the voltage distribution.

Hitherto only lighting systems have been discussed in which the lighting elements, during operation, receive power from the electrodes comprised in the resistive sheet RS and via the resistive sheet and the connection terminals and contact pins. A disadvantage of these lighting systems is a comparatively high power dissipation in the resistive sheet, which adversely affects the efficiency of the lighting system. Several ways exist to overcome this problem, as shown in FIG. 5-FIG. 8.

Figure 5A:
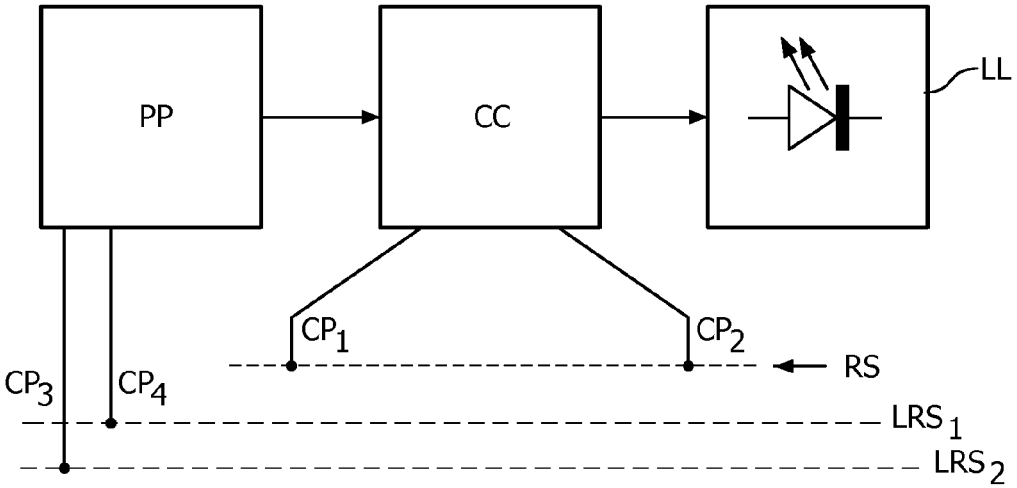
FIGS. 5*a* and 5*b* show schematic representations of lighting systems according to the invention, comprising lighting elements with more than two contact pins and a substrate comprising at least one low-resistance sheet in addition to the resistive sheet.

FIG. 5*a* shows an embodiment of a lighting system wherein the lighting element comprises four contact pins CP1-CP4. Contact pins CP1 and CP2 are connected to input terminals of a control circuit CC. An output of control circuit CC is coupled to a LED load LL. A further input of control circuit CC is coupled to an output of circuit part PP. Respective input terminals of circuit part PP are connected to contact pin CP3 and contact pin CP4, respectively.

The substrate comprised in the lighting system comprises a resistive sheet RS. Contact pins CP1 and CP2 are connected to respective connection terminals comprised in the resistive sheet RS. The substrate further comprises two low-resistance sheets LRS1 and LRS2.

Contact pin CP3 is connected to a connection terminal comprised in low-resistance sheet LRS1 and contact pin CP4 is connected to a connection terminal comprised in low-resistance sheet LRS2.

To each of said low-resistance sheets LRS1 and LRS2, at least one electrode EL1 and EL2, respectively, is connected. Electrodes EL1 and EL2 are connected to respective output terminals of a power supply.

To the resistive sheet RS, several electrodes are connected that in turn are connected to different voltage sources to ensure that an electric field exists in the resistive sheet, so that the voltage between contact pins CP1 and CP2 depends on the position and the orientation of the lighting element on the substrate.

During operation, circuit part PP converts the voltage present between contact pins CP3 and CP4 into a DC supply voltage of suitable magnitude. This DC supply voltage is supplied to control circuit CC. Control circuit CC generates one or more drive currents out of the DC supply voltage and supplies these currents to parts of the LED load LL. These parts are formed for instance by respectively red LEDs, green LEDs and blue LEDs. The magnitudes of the one or more DC currents is determined by the voltage present between contact pin CP1 and contact pin CP2. Because the power consumed by the lighting system is supplied through the low-resistance sheets, power dissipation in these sheets is comparatively low, so that the lighting system operates in an efficient way.

Figure 5B:
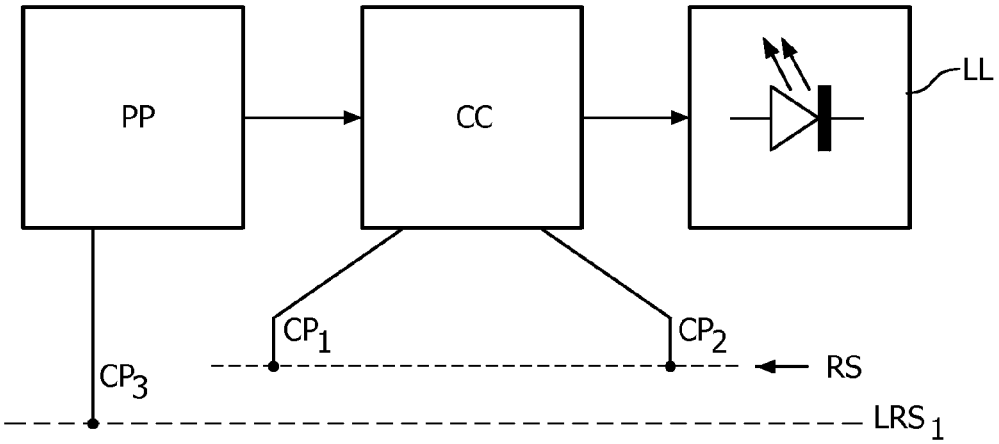

The lighting system shown in FIG. 5*b* differs from that shown in FIG. 5*a* in that the second low-resistance sheet LRS2 and the contact pin CP4 are dispensed with. In this embodiment, RS forms a combined power and data sheet. Its resistance is so low that the voltage present between the contact pins CP1 and CP2 is insufficient to supply a current to the LED load LL via the resistive sheet RS. However, this voltage is measured and amplified using the power received via all three contact pins, so that the resulting voltage is high enough to supply the LED load. It is noted that it is still the voltage between contact pins CP1 and CP2 that determines the power supplied to the LED load LL.

Figure 6:
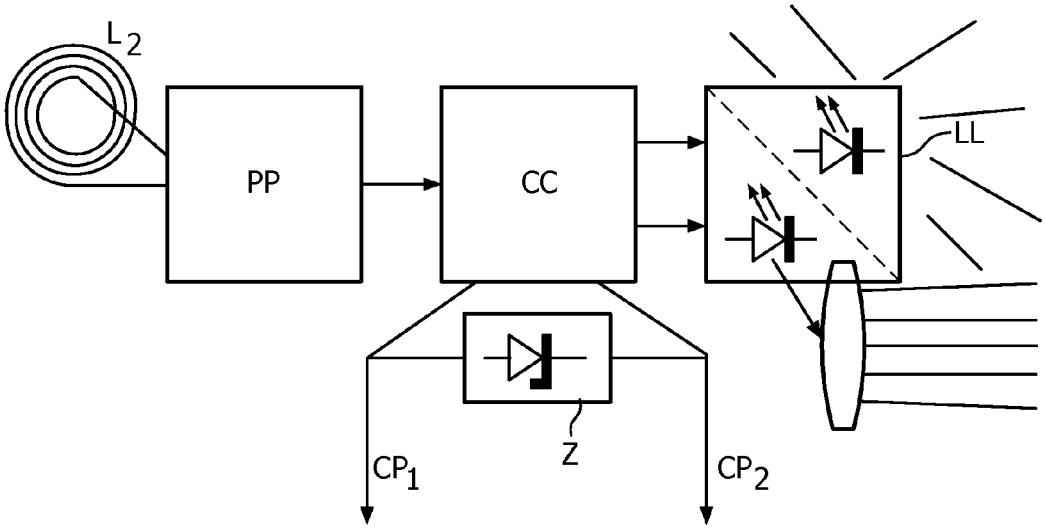
FIGS. 6 and 7 show a schematic representation of lighting elements equipped with circuitry for inductive or capacitive power transfer.
Figure 7:
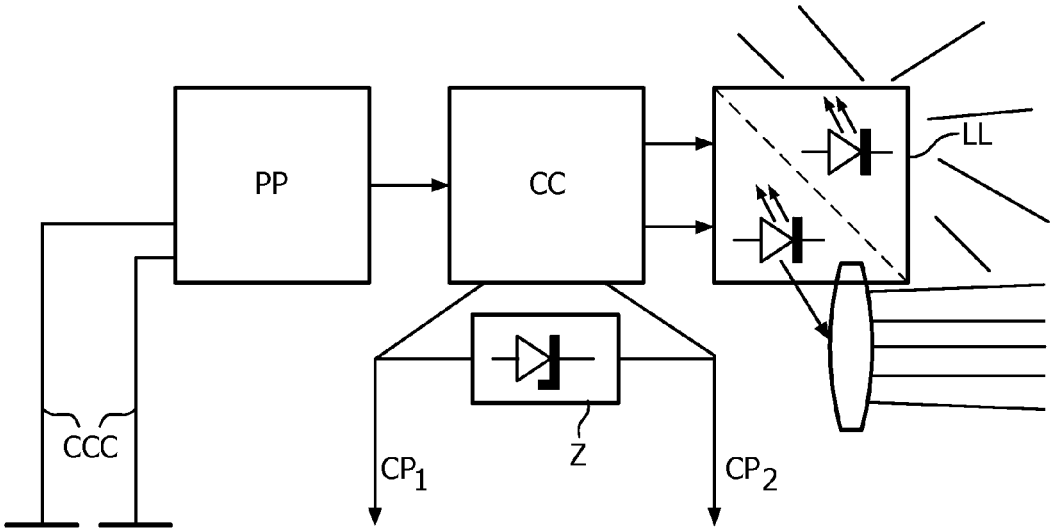

The lighting systems shown in FIG. 6 and FIG. 7 differ from the lighting system shown in FIG. 5A in that the input of circuit part PP is not connected to low-resistance sheets via contact pins to pick up power but to an inductive winding L2 (in FIG. 6) and to capacitive coupling circuitry CCC (in FIG. 7), respectively. In the case of the lighting system shown in FIG. 6, inductive winding L2 needs to be inductively coupled with an inductive winding L1 that is present in or on the substrate. The inductive winding L1 in turn needs to be coupled to an AC power source. Via inductive coupling between inductive windings L1 and L2, power from the AC power supply is coupled to the input of circuit part PP. Circuit part PP subsequently rectifies the AC voltage present at its input and converts the rectified voltage into a DC voltage of substantially constant magnitude that is supplied to the control circuit CC that operates in the same way as described hereinabove with respect to FIG. 5A. Similarly, the capacitive coupling circuitry is meant to couple the input of circuit part PP via a capacitive structure, in part connected to the lighting element and in part present in or on the substrate, to an AC power source. Also in this case, circuit part PP rectifies the AC voltage and converts the rectified AC voltage into a DC voltage of substantially constant magnitude, that is supplied to control circuit CC.

In the lighting systems shown in FIG. 6 and FIG. 7, the LED load LL is divided into two parts, one of which radiates its light in every direction, while the other part is equipped with a lens to couple all, or a substantial part of, the generated light in one particular direction. Of course the LED loads in every embodiment shown in FIG. 1 to FIG. 8 can be divided into similar parts, when desired.

In the lighting systems shown in FIG. 6 and FIG. 7, the contact pins CP1 and CP2 are connected by a Zener diode Z that functions as a voltage clamp. In case another lighting element is connected to the substrate in the direct vicinity of the element clamped by the Zener, the voltage between the contact pins of this other lighting element will be clamped as well. The Zener diode thus forms an additional means to influence the intensity and/or the color of the light generated by a lighting system according to the invention.

Figure 8:
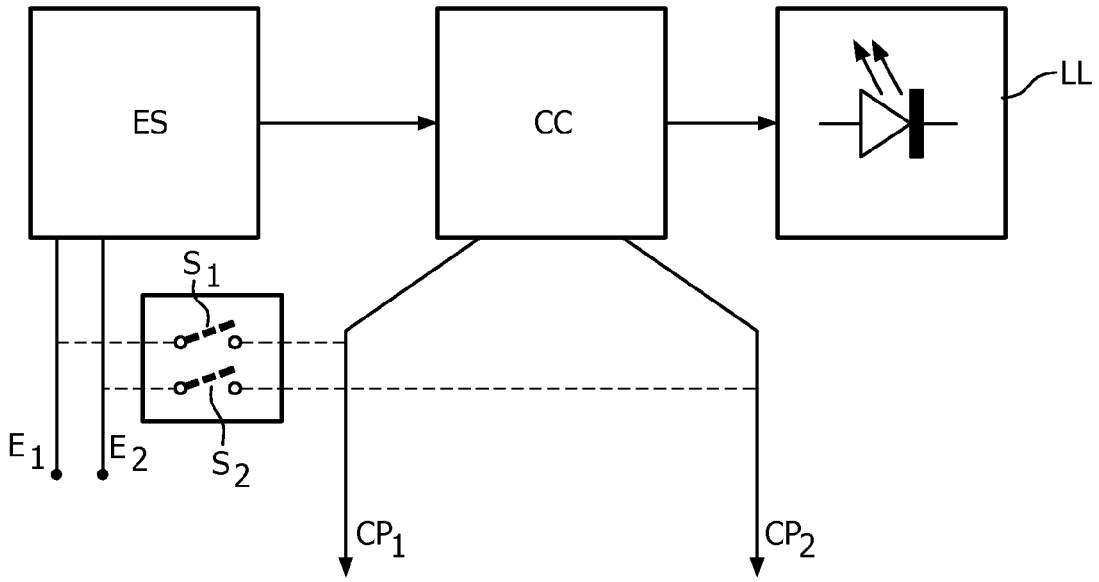
FIG. 8 shows a lighting element equipped with a rechargeable battery.

In FIG. 8, circuit part ES is an energy storage such as a rechargeable battery. During operation, the circuit part ES supplies the DC voltage of the battery to the control circuit CC. The normal operation of the lighting system is otherwise identical to that of the lighting system in FIG. 5A. Circuit part ES is equipped with contacts E1 and E2 for charging the battery. Charging can take place directly through contacts E1 and E2 by means of a charger separate from the substrate. Contacts E1 and E2 can also be connected to contact pins CP1 and CP2 by means of switches S1 and S2 so that charging of the battery can then take place via contact pins CP1 and CP2. Such charging can take place in certain areas of the substrate, where energy is delivered with a comparatively high efficiency. Switches S1 and S2 can be operated manually or by means of a signal. The switches can be rendered non-conductive in case the low input impedance of the circuit part ES changes the voltage difference between the contact pins and thus interferes with the signaling function of the contact pins CP1 and CP2.

While the invention has been illustrated and described in detail in the drawings and foregoing description, such illustration and description are to be considered illustrative or exemplary and not restrictive; the invention is not limited to the disclosed embodiments.

Variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage.

The invention claimed is:

1. Lighting system comprising:

a substrate comprising a resistive sheet and multiple electrodes, each electrode being suitable for connection to a respective voltage source, a plurality of lighting elements, each element comprising a light source (LED) and two contact pins for electrical connection to the resistive sheet, a control circuit for controlling the light output and/or the color of the light generated by the light source in dependence on the voltage between the contact pins, wherein the lighting elements can be connected in different positions and in different orientations and wherein the voltage present between the contact pins depends on the position and orientation of the lighting element.

2. Lighting system according to claim 1, wherein the resistive sheet is equipped with a plurality of electrical connection terminals.

3. Lighting system as claimed in claim 2, wherein the connection of the contact pins to the electrical connection terminals is detachable.

4. Lighting system as claimed in claim 1, wherein the distance between the contact pins of at least part of the lighting elements is adjustable.

5. Lighting system as claimed in claim 1, wherein at least part of the light sources comprised in the lighting elements comprise one or more LEDs.

6. Lighting system as claimed in claim 1, wherein the power consumed by the light source in the light element during operation is supplied by the electrodes through the resistive sheet.

7. Lighting system as claimed in claim 1, wherein the lighting element comprises a battery (ES) and wherein the power consumed by the light source in the light element during operation is supplied from the battery.

8. Lighting system as claimed in claim 7, wherein the battery is rechargeable.

9. Lighting system as claimed in claim 1, wherein the substrate and part of the lighting elements are equipped with circuitry for capacitive or inductive power transfer and wherein the power consumed by the light source in the light element during operation is supplied via the capacitive or inductive power transfer.

10. Lighting system as claimed in claim 9, wherein the substrate comprises a second low-resistance sheet (LRS2), arranged in parallel to the resistive sheet and equipped with at least one electrode, and wherein at least part of the lighting elements comprises a third contact pin for electrical connection to the first low-resistance sheet and a fourth contact pin for electrical connection to the second low-resistance sheet.

11. Lighting system as claimed in claim 10, wherein the second low-resistance sheet is equipped with a plurality of electrical connection terminals.

12. Lighting system as claimed in claim 1, wherein the substrate further comprises a first low-resistance sheet (LRS1), arranged in parallel to the resistive sheet and equipped with at least one electrode, and wherein at least part of the lighting elements comprises a third contact pin for electrical connection to the first low-resistance sheet.

13. Lighting system as claimed in claim 12, wherein the first low-resistance sheet is equipped with a plurality of electrical connection terminals.

14. Method of operating a lighting system comprising the steps of:

providing a substrate comprising a resistive sheet comprising multiple electrical connection terminals and multiple electrodes, each electrode being suitable for connection to a respective voltage source, providing a plurality of lighting elements, each element comprising a light source and two contact pins for electrical connection to respective electrical connection terminals, connecting the electrodes to respective voltage sources, connecting the lighting elements in different positions and in different orientations, so that the voltage present between the contact pins depends on the position and orientation of the lighting element, and controlling the light output and/or the color of the light generated by the lighting element in dependence on the magnitude of the voltage between the contact pins of the lighting element.

* * * * *